US007103297B2

(12) United States Patent
Guy et al.

(10) Patent No.: US 7,103,297 B2
(45) Date of Patent: Sep. 5, 2006

(54) ROBUST APPARATUS AND METHOD OF GROUNDING A DRUM PHOTORECEPTOR ASSEMBLY

(75) Inventors: Bernard L. Guy, Rochester, NY (US); Martin J. Curynski, Webster, NY (US); Bruce A. Dangelmaier, W. Henrietta, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/995,578

(22) Filed: Nov. 23, 2004

(65) Prior Publication Data

US 2006/0110180 A1 May 25, 2006

(51) Int. Cl.
*G03G 15/00* (2006.01)

(52) U.S. Cl. ..... 399/90; 399/116; 399/117; 361/214; 361/221

(58) Field of Classification Search ..... 399/90, 399/116, 117
See application file for complete search history.

(56) References Cited

U.S. PATENT DOCUMENTS 5,130,751 A * 7/1992 Sato et al. ..... 399/96
5,537,189 A 7/1996 Imes ..... 355/210
5,752,136 A 5/1998 Sanchez et al. ..... 399/117
5,815,773 A 9/1998 Zaman ..... 399/117
6,876,827 B1 * 4/2005 Michlin ..... 399/90

FOREIGN PATENT DOCUMENTS

JP 07072764 A * 3/1995
JP 2004109353 A * 4/2004

* cited by examiner

*Primary Examiner*—David M. Gray
*Assistant Examiner*—Ryan D. Walsh
(74) *Attorney, Agent, or Firm*—Tallam I. Nguti

(57) ABSTRACT

A grounding method and apparatus for robustly grounding a photoreceptor assembly, including a conductive photoreceptor drum, in a xerographic image producing machine. The grounding apparatus includes (a) a flange including a first portion having a first diameter and a second portion having a second and smaller diameter; (b) a conductive plating formed on said flange presenting a relatively large conductive surface area for contactably assembling against walls of the conductive photoreceptor drum; and (c) an electrical connector for electrically connecting the large conductive surface area of the conductive plating to an electrically conductive drive shaft of the xerographic image producing machine.

20 Claims, 4 Drawing Sheets

ROBUST APPARATUS AND METHOD OF GROUNDING A DRUM PHOTORECEPTOR ASSEMBLY

This disclosure relates to xerographic or electrostatographic printing machines, and more particularly to a robust apparatus and method of grounding an electrically conductive drum photoreceptor assembly in such a printing machine. The phrase printing machine includes both printing and copying devices.

As is well known, the electrically conductive photoreceptor in an electrophotographic or xerographic printing machine requires grounding for proper operation. One conventional grounding apparatus and method employs a metal strip mechanically attached to one of the non-metallic flanges that cap the ends of the electrically conductive photoreceptor. One end of the metal strip contacts the inside of the electrically conductive photoreceptor while the other end of the metal strip contacts the center metal shaft which rotates the photoreceptor, thus completing the grounding circuit. Any deformation of the metal strip during assembly, however, can result in loss of ground, either permanently or intermittently. Repair of the metal strip within the photoreceptor is difficult since the end flanges are glued in.

Examples of prior efforts at grounding the conductive photoreceptor include U.S. Pat. No. 5,537,189 entitled "Printing apparatus which grounds photoreceptor independently of CRU" that discloses an electrostatographic printing apparatus having (a) a detachable imaging module including a housing and a photosensitive member, wherein the photosensitive member is partially enclosed within the housing, and wherein the photosensitive member has an outer surface which includes an electrically conductive portion; (b) an electrically grounded component free of attachment to the module; and (c) an electrically conductive part, free of attachment to the module, in contact with both the grounded component and the conductive portion on the outer surface of the photosensitive member, thereby establishing grounding of the photosensitive member, and wherein upon removal of the imaging module the part remains in contact with the grounded component and upon insertion of a new detachable imaging module which has a new photosensitive member having an outer surface that includes an electrically conductive portion, the part contacts the electrically conductive portion on the outer surface of the new photosensitive member, thereby establishing grounding of the new photosensitive member.

U.S. Pat. No. 5,815,773 entitled "Composite photoreceptor flange" discloses an end flange capable of translating a rotational force from an outside source to a hollow cylindrical member is disclosed. The end flange is made from a composition which includes polycarbonate, polytetrafluorethylene, and glass. The end flange may be used to rotate an electrophotographic imaging member past a charging station, for generation of a uniform electrical potential thereon, and subsequent selective discharging of the imaging member and development of an electrostatic latent image. Most notably, mounting of the end flange to the imaging member does not require the use of an adhesive material. This enables successful recycling of the imaging member, and results in significant cost savings.

U.S. Pat. No. 5,752,136 entitled "Imaging member end flange and end flange assembly" discloses a hollow cylindrical electrostatographic imaging member supporting end flange including a disk shaped member, a supporting hub extending axially from the disk shaped member and a metal disk coaxially secured to the hub, the disk comprising a plurality of rectangular tabs extending radially from the disk in a direction away from an imaginary axis of the hub for engagement with the hollow cylindrical electrostatographic imaging member upon insertion of the hub and disk shaped member into one end of the hollow cylindrical electrostatographic imaging member. When this end flange is inserted into one end of the hollow cylindrical electrostatographic imaging member, the plurality of rectangular tabs extending radially from the disk engage the inner surface of the hollow cylindrical electrostatographic imaging member.

Unfortunately, it has been found that electrical connections using such tabs or clips is not always properly made due to corrosion of or damage to the tabs or clips which are, of a necessity, made from a lightweight strip of very flexible and hence easily damaged strip of metal. These tabs or clips in addition only present a relatively small surface area to work with, and damage to them often includes bending. They may also be installed improperly and foreign material such as glue used to secure the drum to the flange may also interfere with this connection.

SUMMARY

In accordance with the present disclosure, there is provided a grounding method and apparatus for robustly grounding a photoreceptor assembly, including a conductive photoreceptor drum, in a xerographic image producing machine. The grounding apparatus includes (a) a flange including a first portion having a first diameter and a second portion having a second and smaller diameter; (b) a conductive plating formed on said flange presenting a relatively large conductive surface area for contactably assembling against walls of the conductive photoreceptor drum; and (c) an electrical connector for electrically connecting the large conductive surface area of the conductive plating to an electrically conductive drive shaft of the xerographic image producing machine.

BRIEF DESCRIPTION OF DRAWINGS

Other aspects of the present disclosure will become apparent as the following description proceeds and upon reference to the Figures in which.

DETAILED DESCRIPTION

While the present disclosure will be described in connection with a preferred embodiment thereof, it will be understood that it is not intended to limit the disclosure to that embodiment. On the contrary, it is intended to cover all alternatives, modifications, and equivalents as may be included within the spirit and scope of the disclosure as defined by the appended claims.

Figure 1:
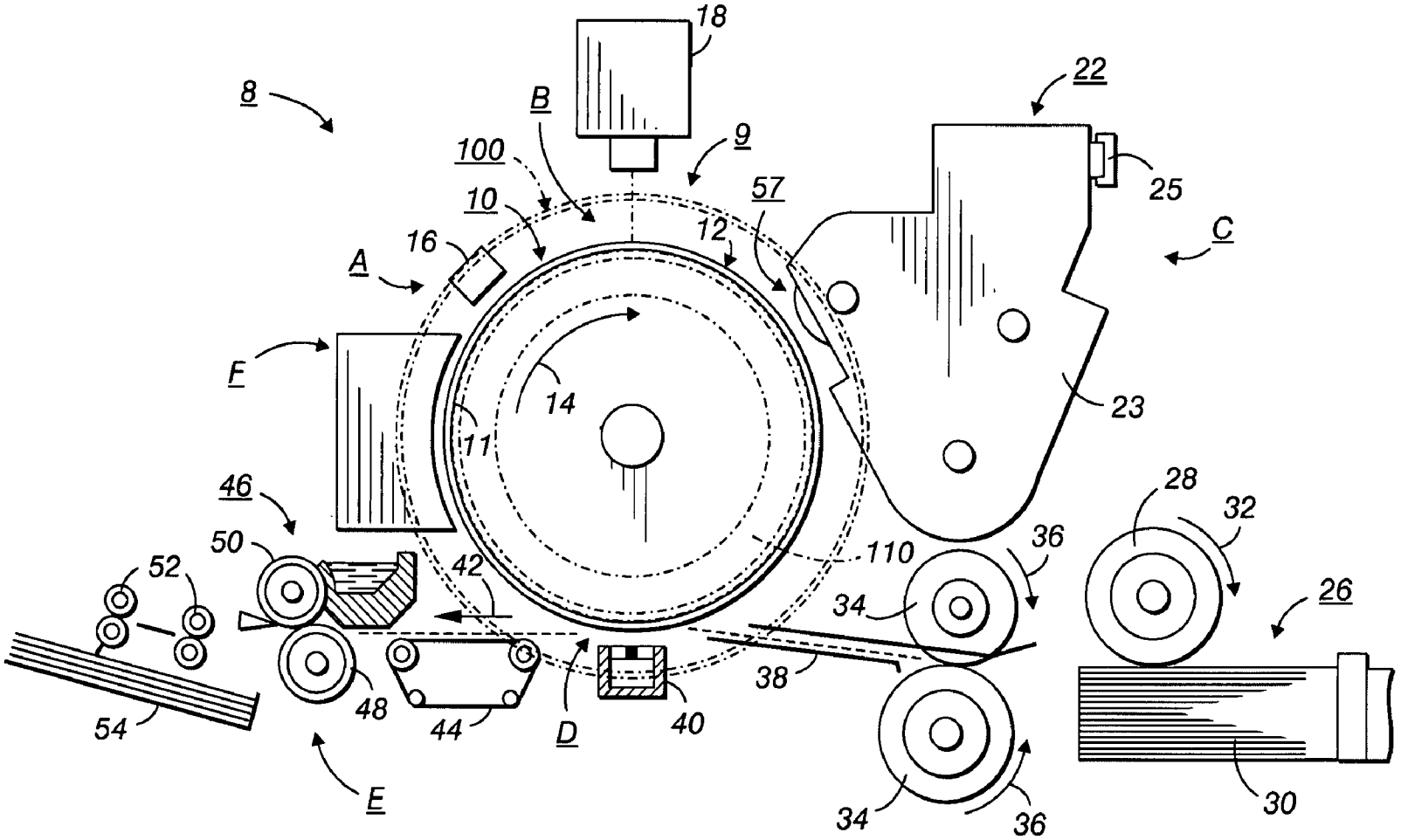
FIG. 1 is a schematic view of an exemplary electrophotographic printing machine including a drum photoreceptor and the robust grounding apparatus of the present disclosure.

Referring first to FIG. 1, an exemplary electrostatographic reproduction machine 8 that employs a photoreceptor assembly 9 including a drum 10 having a conductive substrate conductive or wall 11 and a photoconductive image carrying surface 12. Preferably, photoconductive surface 12 comprises a selenium alloy or organic photoreceptor (OPC) with the conductive substrate being an electrically grounded aluminum alloy. Drum 10 moves in the direction of arrow 14 to advance successive portions of photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantially uniform potential.

Next, the charged portion of photoconductive surface 12 is advanced through imaging station B. Imaging station B includes an exposure system, indicated generally by the reference numeral 18. Exposure system 18 includes lamps that illuminate an original document positioned face down upon a transparent platen. The light rays reflected from the original document are transmitted through a lens to form a light image thereof. The light image is focused onto the charged portion of photoconductive surface 12 to selectively dissipate the charge thereon. This records an electrostatic latent image on photoconductive surface 12 that corresponds to the information in the original document.

Alternatively, exposure system 18 may be a laser-beam raster output scanner (ROS), such as used in a Laser Printer or Digital Copier. As is well known, in such a device a finely focused laser beam is made to scan repeatedly along the length of the charged portion of drum 10 while it advances beneath the beam. The light intensity of the laser beam is electronically modulated in order to selectively dissipate the charge on drum 10 thus creating an electrostatic latent image on photoconductive surface 12 which corresponds to the information required to be printed.

As a further alternative, exposure system 18 may be an array of light emitting diodes (LEDs) that illuminate the charged portion of drum 10 while it advances beneath the LED array. The light intensity of the LEDs is electronically modulated in order to selectively dissipate the charge on drum 10 thus creating an electrostatic latent image on photoconductive surface 12 which corresponds to the information required to be printed. Thereafter, drum 10 advances the electrostatic latent image recorded on photoconductive surface 12 to development station C.

At development station C, a developer unit 22 includes a hopper 23 with a capped refill opening 25. The development unit 22 also has a magnetic roll assembly 57, which transports a developer mixture of carrier granules having toner particles adhering triboelectrically thereto into contact with the electrostatic latent image. Toner particles are attracted from the carrier granules to the latent image forming a toner powder image.

Alternatively the developer material may be of the single component type. As is well known, such a developer material does not contain carrier granules but the toner (dry ink) particles are themselves magnetic and can therefore be transported by the magnetic roll assembly 57 without the need for carrier granules. In this mode of development toner particles are attracted directly from magnetic roll assembly 57 to the electrostatic latent image on drum 10, thus forming a toner powder image on the surface of the drum 10.

After development of the electrostatic latent image, drum 10 advances the toner powder image to transfer station D. At transfer station D, a copy substrate such as a sheet of support material is moved into contact with the toner powder image. The sheet of support material is advanced to transfer station D by a sheet feeding apparatus, indicated generally by the reference numeral 26. Preferably, sheet feeding apparatus 26 includes a feed roll 28 contacting the uppermost sheet of a stack of sheets 30. Feed roll 28 rotates in the direction of arrow 32 to advance the uppermost sheet into a nip defined by forwarding rollers 34. Forwarding rollers 34 rotate in the direction of arrow 36 to advance the sheet into chute 38. Chute 38 directs the advancing sheet into contact with photoconductive surface 12 in a timed sequence so that the toner powder image developed thereon contacts the advancing sheet at transfer station D.

Transfer station D includes a corona generating device 40, which sprays ions onto the backside of the sheet. This attracts the toner powder image from photoconductive surface 12 to the sheet. After transfer, the sheet continues to move in the direction of arrow 42 on conveyor 44 to advance to fusing station E.

Fusing station E includes a fuser assembly, indicated generally by the reference numeral 46, which permanently affixes the transferred toner powder image to the sheet. Preferably, fuser assembly 46 includes a back-up roll and a heated fuser roller 50. The sheet passes between fuser roller 50 and back-up roll with the powder image contacting fuser roller 50. In this manner, the toner powder image is permanently affixed to the sheet. After fusing, forwarding rollers 52 advance the sheet to catch tray 54 for subsequent removal from the reproduction machine by the operator.

After the powder image is transferred from photoconductive surface 12 to the copy sheet, drum 10 rotates the photoconductive surface to cleaning station F. At cleaning station F, a cleaning system, employing a magnetic roll assembly 57, for example, substantially identical to the magnetic roll assembly 57 of the developer unit 22, removes the residual particles adhering to photoconductive surface 12. The magnetic roll assembly 57 transports carrier granules closely adjacent to the photoconductive surface to attract residual toner particles thereto. In this way, the residual toner particles are removed from photoconductive surface 12.

Alternatively the cleaning station F may consist of a stationary elastomer cleaner blade that contacts the photoconductive surface 12. As is well known, such a cleaner-blade scrapes the toner off the surface photoconductive surface 12. The waste toner may be collected within the cleaning station F or transported out of the cleaning station F into a waste-toner container.

It is believed that the foregoing description is sufficient for purposes of the present disclosure to illustrate the general operation of a toner image producing machine, such as an electrostatographic reproduction machine 8, incorporating the features of the present disclosure therein.

Figure 2:
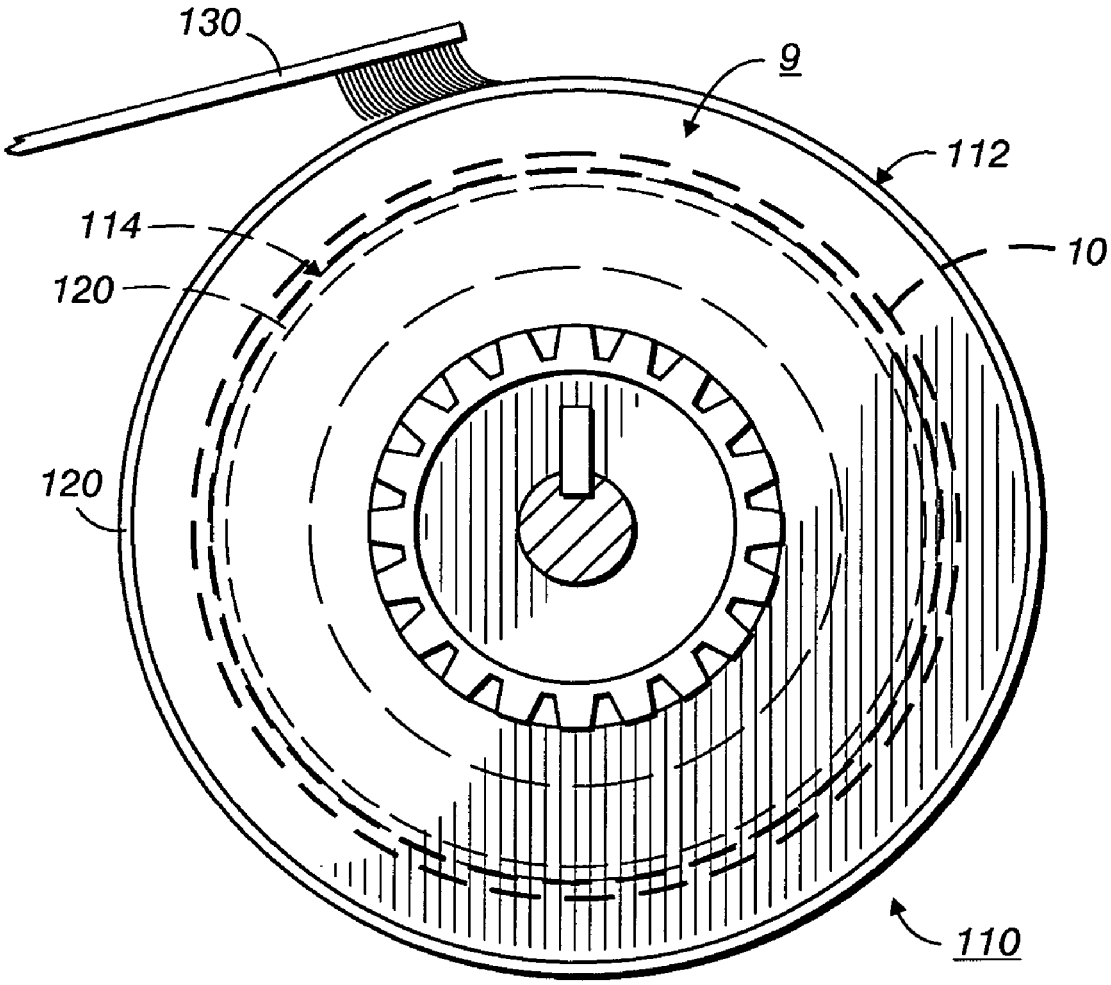
FIG. 2 is an end view of one end of the drum photoreceptor and the robust grounding apparatus of the present disclosure.
Figure 3:
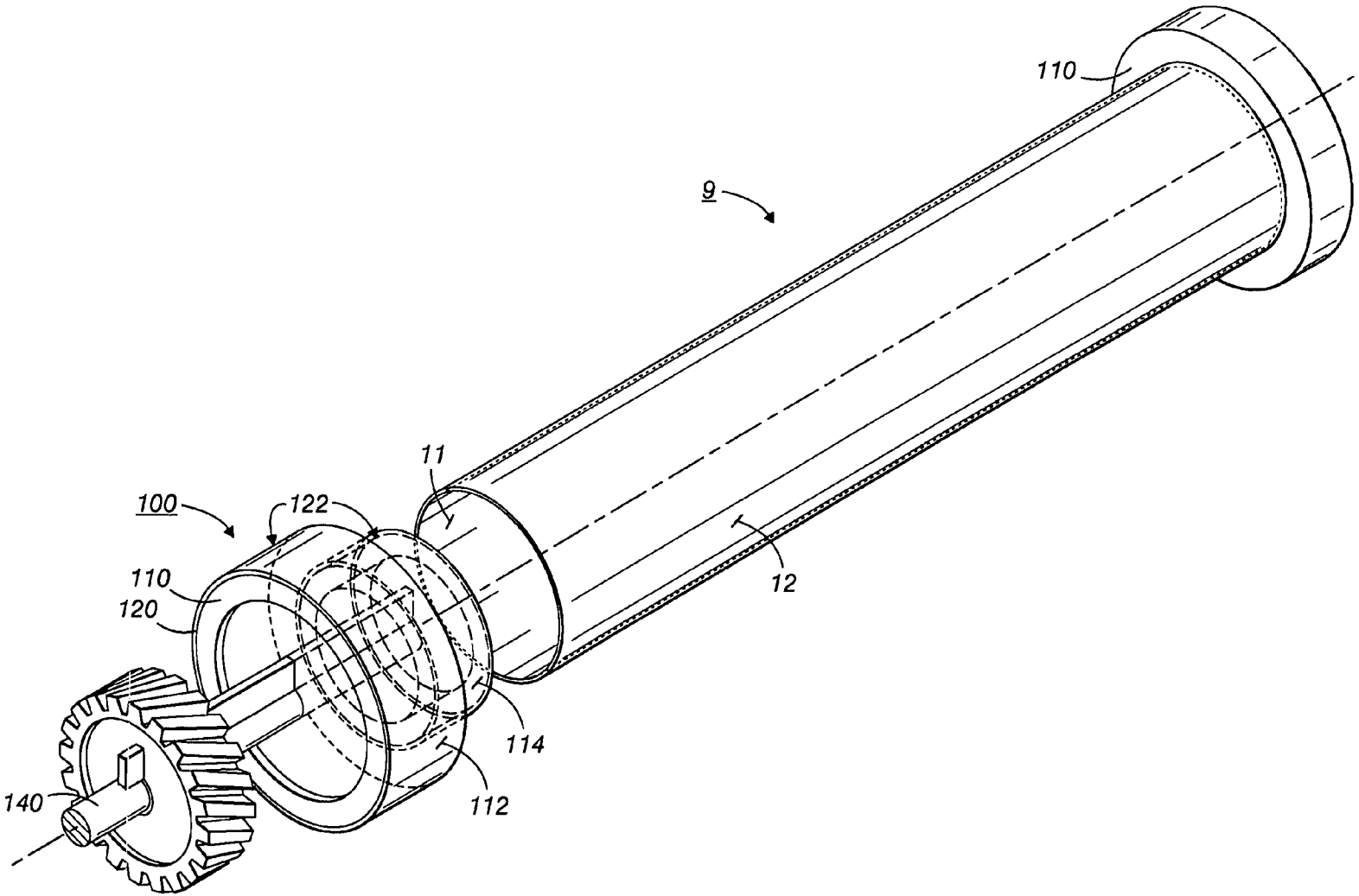
FIG. 3 is a perspective view of the drum photoreceptor and plated flange of the robust grounding apparatus of the present disclosure.
Figure 4:
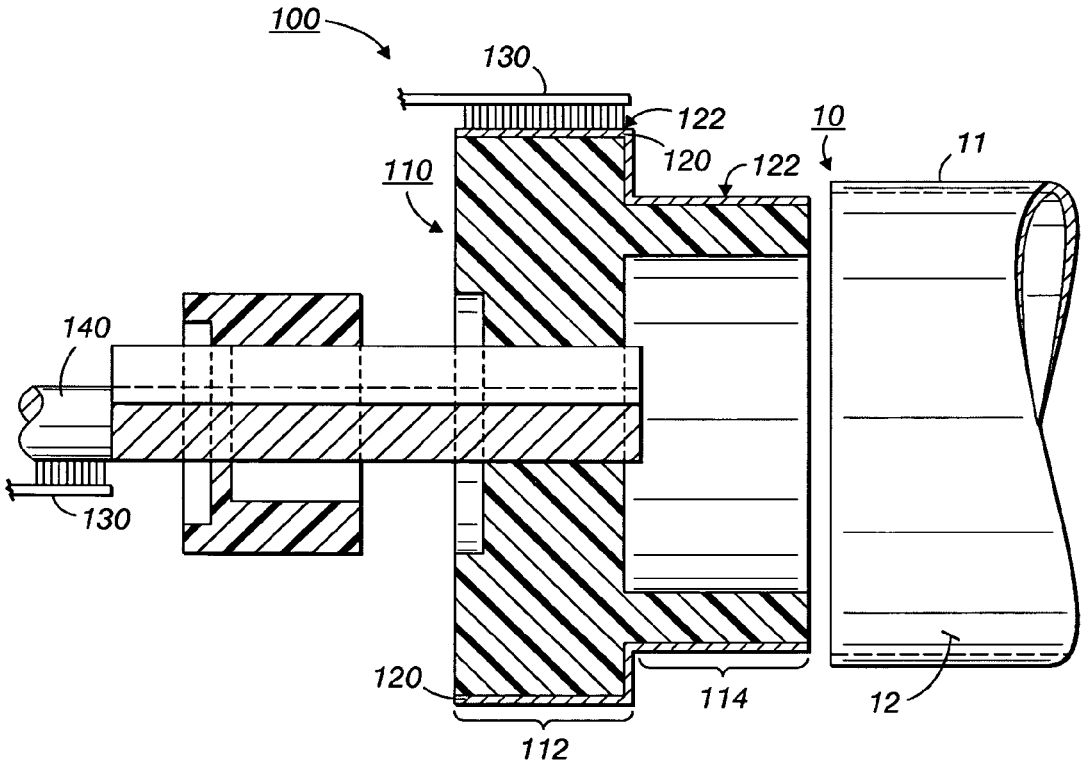
FIG. 4 is a sectional view of a portion of the drum photoreceptor with the robust grounding apparatus of the present disclosure.

Referring now to FIGS. 2–4, the grounding apparatus 100 of the present disclosure, as illustrated, is suitable for robustly grounding the photoreceptor assembly (PRA) 9 including a conductive photoreceptor drum 10 in a xerographic image producing machine 8. As shown, the grounding apparatus 100 in one embodiment includes (a) a flange 110 including a first portion 112 having a first diameter D1 for protruding above the outer surface of the drum 10 as shown in FIG. 2 for example, and a second portion 114 having a second and relatively smaller diameter D2 for inserting into an inside diameter of the drum 10 as shown; (b) a conductive plating 120 electro-plated or electro-formed on the outer surface of the flange 110 and including or presenting a relatively large conductive top external surface area 122 on the first portion 112, and on the second portion 114 as shown for contactably assembling as shown against the inside of the conductive wall 11 of the conductive photoreceptor drum 10; and (c) an electrical connector 130 for electrically connecting the large conductive surface area 122 of the conductive plating 120 to an electrically conductive drive shaft 140 of the xerographic image producing machine, thereby grounding the conductive photoreceptor drum.

In another embodiment, the grounding apparatus 100 includes (a) the electrically conductive drive shaft 140 of the xerographic image producing machine for driving the conductive photoreceptor drum 10 of the photoreceptor assembly; (b) the flange 110 including the first portion 112 having the first diameter D1 for protruding above the outer surface of the drum 10 as shown in FIG. 2 for example, and the second portion 114 having the second and relatively smaller diameter D2 for inserting into an inside diameter of the drum 10 as shown; the conductive plating 120 electro-plated or electro-formed on the outer surface of the flange and including or presenting the relatively large conductive top external surface area 122 on the first portion 112, and on the second portion 114 as shown for contactably assembling as shown against the inside of a wall of the conductive photoreceptor drum; and (d) the electrical connector 130 for electrically connecting the large conductive surface area of the conductive plating to a grounded conductive portion such as the drive shaft 140 of the xerographic image producing machine, thereby grounding the conductive photoreceptor drum. The grounded conductive portion is shown as a conductive drive shaft for the conductive photoreceptor drum 10 but such a grounded conductive portion can equally be any conductive element or part of the frame of the machine 8.

Thus in accordance with the present disclosure, the robust method of grounding a photoreceptor drum assembly (PRA) 9 in the xerographic image producing machine 8 includes (a) electro-plating a protruding flange 110 of a conductive photoreceptor drum 10 of the PRA using a conductive material to form a plated flange 110 having a conductive plating including a relatively large conductive top external surface area 122; (b) contactably assembling the relatively large surface area 122 of the conductive plating 120 to and against the inside of a wall of the conductive photoreceptor drum 10; and (c) electrically connecting the relatively large conductive top external surface area 122 of the conductive plating to a grounded conductive portion such as the drive shaft 140 of the xerographic image producing machine 8. The step of electro-plating comprises electro-plating the flange 110 with nickel as the conductive material. Alternatively, the step of electro-plating can comprise electro-plating the flange 110 with aluminum as the conductive material. The step of electrically connecting the relatively large conductive top external surface area 122 of the conductive plating 120 to a grounded conductive portion comprises electrically connecting the relatively large surface area of the conductive plating to a grounded conductive drive shaft 140 of the xerographic image producing machine for driving the photoreceptor drum.

Further, in another embodiment, the step of contactably assembling the relatively large surface area of the conductive plating to the conductive photoreceptor drum comprises press-fitting a relatively smaller portion 114 of the plated flange 110 into conductive contact with a wall, specifically with the interior wall 11 of the conductive photoreceptor drum 10. In another embodiment, the step of contactably assembling the conductive flange to the conductive photoreceptor drum comprises gluing the relatively smaller portion 114 of the plated flange using a layer of conductive glue into conductive contact with the wall of the photoreceptor drum.

Thus this disclosure consists of a photoreceptor flange that is electro-plated either fully or partly with a suitable metal such as nickel or aluminum in order to provide a less costly and more electronically stable connection between the photoreceptor assembly and the rest of the machine.

A plastic flange for example, is electroplated with nickel, aluminum, or another suitable metal. The metallic plated flange is then press fitted into an open end of the photoreceptor drum. The plating gives the flange a relatively very large surface area to connect to the aluminum drum as compared to one conventional method of using spring clips for such a connection. The electrical connection is made from a drive shaft for driving the conductive photoreceptor drum directly to the metallic plated flange and then through the metallic plating on the flange to the aluminum drum of the photo receptor assembly. Compared to such connections made with spring clips, the robust connection using the plated flange results in a cost saving and improves the quality and reliability of the connection due to the more robust electrical connection between the drum, flange, and shaft.

As can be seen, there has been provided a grounding method and apparatus for robustly grounding a photoreceptor assembly, including a conductive photoreceptor drum, in a xerographic image producing machine. The grounding apparatus includes (a) a flange including a first portion having a first diameter and a second portion having a second and smaller diameter; (b) a conductive plating formed on said flange presenting a relatively large conductive surface area for contactably assembling against walls of the conductive photoreceptor drum; and (c) an electrical connector for electrically connecting the large conductive surface area of the conductive plating to an electrically conductive drive shaft of the xerographic image producing machine.

What is claimed is:

1. A robust method of grounding a photoreceptor drum assembly (PRA) in a xerographic image producing machine, the method comprising:

(a) electro-plating a flange of a conductive photoreceptor drum of the PRA flange including a relatively large conductive top external surface area of a first portion having a first diameter for protruding above the outer surface of the drum and a second portion having a second and relatively smaller diameter for inserting into an inside diameter of the drum, using a conductive material so as to form a plated flange having a conductive plating including said relatively large conductive top external surface area on said first portion and said second portion;

(b) contactably assembling said relatively large surface area of said conductive plating on said second portion to and against an inside diameter of a wall of the conductive photoreceptor drum; and (c) electrically connecting said relatively large surface area of said conductive plating to a grounded conductive portion of the xerographic image producing machine.

2. The method of claim 1, wherein said step of electroplating comprises electro-plating said flange with nickel as the conductive material.

3. The method of claim 1, wherein said step of electroplating comprises electro-plating said flange with aluminum as the conductive material.

4. The method of claim 1, wherein contactably assembling said relatively large surface area of said conductive plating to the conductive photoreceptor drum comprises press-fitting said second portion of said plated flange into conductive contact with walls of said photoreceptor drum.

5. The method of claim 1, wherein contactably assembling the conductive flange to said conductive photoreceptor drum comprises gluing said second portion of said plated flange with conductive glue into conductive contact with walls of said photoreceptor drum.

6. The method of claim 1, wherein electrically connecting said relatively large surface area of said conductive plating to a grounded conductive portion comprises electrically connecting said relatively large surface area of said conductive plating of said first portion to a grounded conductive drive shaft of the xerographic image producing machine for driving the photoreceptor drum.

7. Grounding apparatus for robustly grounding a photoreceptor assembly including a conductive photoreceptor drum in a xerographic image producing machine, the grounding apparatus comprising:

(a) a flange including a first portion having a first diameter for protruding above a surface of the conductive photoreceptor drum and a second portion having a second and relatively smaller diameter for inserting into an inside diameter of the conductive photoreceptor drum;

(b) a conductive plating electro-formed on a top external surface area of said first portion and said second portion of said flange and including a relatively large conductive surface area on said second portion for contactably assembling against walls of the conductive photoreceptor drum;

(c) an electrical connector for electrically connecting said relatively large conductive surface area of the conductive plating to an electrically conductive drive shaft of the xerographic image producing machine, thereby grounding the conductive photoreceptor drum.

8. The apparatus of claim 7, wherein said conductive plating comprises nickel.

9. The apparatus of claim 7, wherein said conductive plating comprises aluminum.

10. The apparatus of claim 7, wherein said second portion of said flange having said conductive plating is press-filled into contact with a wall of said conductive photoreceptor drum.

11. The apparatus of claim 7, wherein said flange is made of a plastic material.

12. The apparatus of claim 7, including a conductive glue layer formed over said conductive plating on said second portion of said flange for gluing said flange into contact with a wall of said conductive photoreceptor drum.

13. The apparatus of claim 7, where said electrical connector is mounted for contacting said large conductive surface area of said plating on said first portion of said flange and said conductive drive shaft.

14. A xerographic image producing machine comprising:

(a) a machine frame;

(b) substrate supply and feeding means for supplying and feeding an image receiving substrate through said machine frame;

(c) imaging means including a photoreceptor assembly having a moveable photoreceptor drum; and (d) grounding apparatus for robustly grounding said photoreceptor drum, said grounding apparatus including:

(i) an electrically conductive drive shaft of the xerographic image producing machine for driving said conductive photoreceptor drum of said photoreceptor assembly;

(ii) a flange including a first portion having a first diameter for protruding above a surface of the conductive photoreceptor drum and a second portion having a second and relatively smaller diameter for inserting into an inside diameter of the conductive photoreceptor drum;

(iii) a conductive plating electro-formed on a top external surface area of said first portion and said second portion of said flange and including a relatively large conductive surface area on said second portion for contactably assembling against walls of the conductive photoreceptor drum; and (iv) a first electrical connector for electrically connecting the large conductive surface area of the conductive plating to a grounded portion of the xerographic image producing machine, thereby grounding the conductive photoreceptor drum.

15. The xerographic image producing machine of claim 14, wherein said conductive plating comprises nickel.

16. The xerographic image producing machine of claim 14, wherein said conductive plating comprises aluminum.

17. The xerographic image producing machine of claim 14, wherein said flange having said conductive plating is press-fitted into contact with walls at an end of said conductive photoreceptor drum.

18. The xerographic image producing machine of claim 14, wherein said flange is made of a plastic material.

19. The xerographic image producing machine of claim 14, wherein said grounded portion of the xerographic image producing machine comprises an electrically conductive drive shaft for driving said conductive photoreceptor drum.

20. The xerographic image producing machine of claim 14, including a conductive glue layer for gluing said flange having said conductive plating into contact with walls at an end of said conductive photoreceptor drum.

* * * * *